US005566659A

United States Patent [19]

Franzke et al.

[11] Patent Number: 5,566,659

[45] Date of Patent: Oct. 22, 1996

[54] METHOD AND DEVICE FOR CONTROLLING AN ELECTROMAGNETIC LOAD

[75] Inventors: Klaus Franzke, Leonberg; Stefan Keller, Eberdingen, both of Germany

[73] Assignee: Robert Bosch GmbH, Stuttgart, Germany

[21] Appl. No.: 424,943

[22] Filed: Apr. 19, 1995

[30] Foreign Application Priority Data

May 2, 1994 [DE] Germany ..... 44 15 361.9

[51] Int. Cl.[6] ..... F02M 51/00

[52] U.S. Cl. ..... 123/490

[58] Field of Search ..... 123/490; 361/139, 361/160

[56] References Cited

U.S. PATENT DOCUMENTS

| | | | |
|---|---|---|---|
| 4,073,270 | 2/1978 | Endo | 123/490 |
| 4,082,066 | 4/1978 | Long | 123/490 |
| 4,190,022 | 2/1980 | Long | 123/490 |
| 4,492,913 | 1/1985 | Arnold et al. | 123/490 |
| 4,680,667 | 7/1987 | Petrie | 123/490 |
| 4,736,267 | 4/1988 | Karlmann et al. | 123/490 |
| 4,950,974 | 8/1990 | Pagano | 123/490 |
| 4,953,056 | 8/1990 | Yakuya et al. | 123/490 |
| 5,053,911 | 10/1992 | Kopec et al. | 123/490 |

*Primary Examiner*—Raymond A. Nelli
*Attorney, Agent, or Firm*—Kenyon & Kenyon

[57] ABSTRACT

In a method and device for driving an electromagnetic load, especially a solenoid valve, which influences the fuel quantity to be injected into an internal combustion engine, the duration of the drive of the solenoid valve can be corrected by a delay time. The delay time can be predetermined as a function of the power supplied to the load.

11 Claims, 2 Drawing Sheets

METHOD AND DEVICE FOR CONTROLLING AN ELECTROMAGNETIC LOAD

FIELD OF THE INVENTION

The present invention relates to a method and a device for controlling an electromagnetic load, and in particular an electromagnetic load used for controlling the fuel metering for an internal combustion engine.

BACKGROUND INFORMATION

Methods and devices for controlling the fuel quantity to be injected are known. In the case of these methods and devices, a solenoid valve governs the injection duration. In the case of solenoid valves, a specific time interval passes between the drive point in time and the reaction of the solenoid valve. This time interval is normally called the delay time, the pull-in time or the drop-out time of the valve. This delay time depends, inter alia, on the coil temperature and various other parameters. A variable solenoid valve delay time, in turn, results in a variable injection duration and, thus, a changing injected fuel quantity.

SUMMARY OF THE INVENTION

The present invention is directed to a method and device for controlling an electromagnetic load, and in particular a solenoid valve. A delay time is predetermined as a function of the power supplied to the load. The time duration of driving the load is corrected as a function of the predetermined delay time. The load is driven for the corrected time duration.

The method and device according to the present invention allow the accuracy of the fuel metering (the injected fuel quantity) to be considerably improved.

DETAILED DESCRIPTION

The present invention is described in the following text using the example of a device for controlling the fuel quantity to be injected into an internal combustion engine. However, the present invention is in no way limited to this application, but rather can always be used whenever the drive duration of an electromagnetic load governs a variable, such as the volume flow of a medium passing through the solenoid valve, for example.

Figure 1:
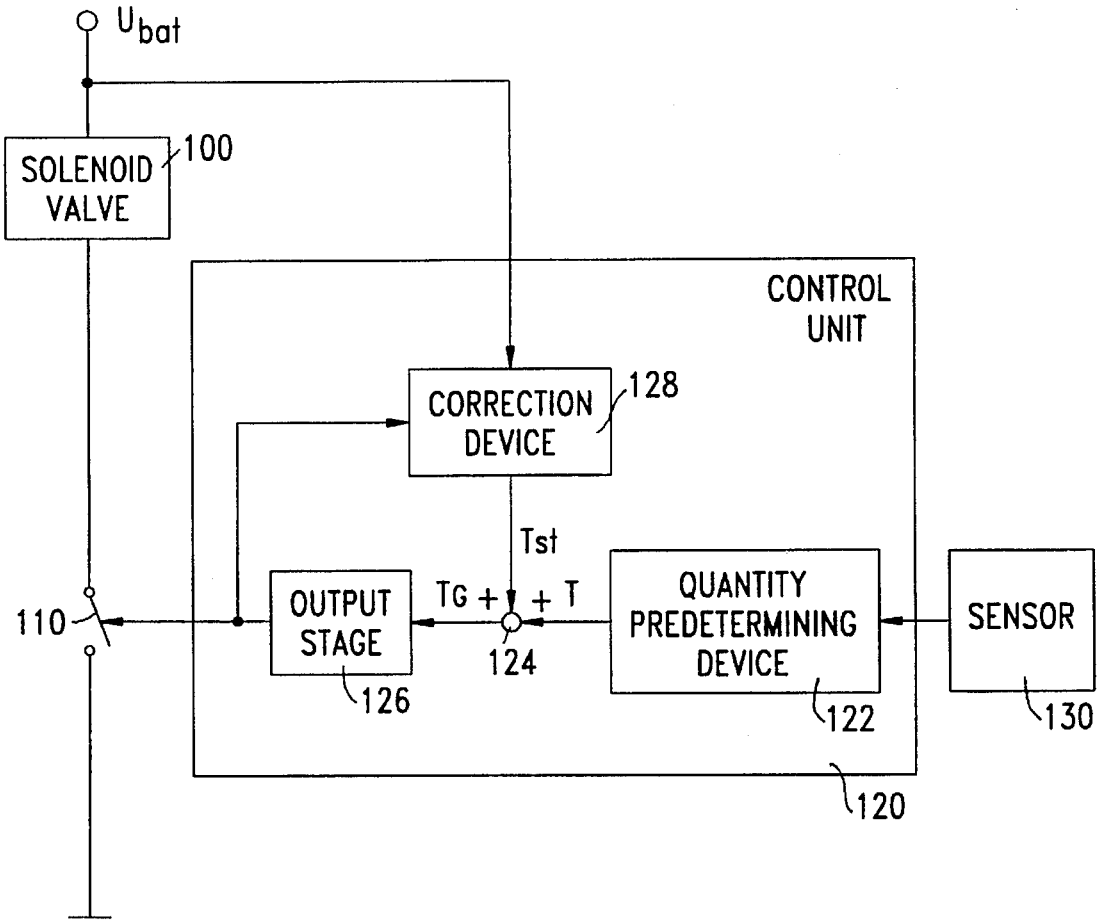
FIG. 1 shows a block diagram of the device according to the present invention, illustrating, in addition, the method according to the present invention.

FIG. 1 shows the essential elements of the device according to the present invention for controlling the fuel quantity to be injected, using the example of control of an internal combustion engine. 100 designates a solenoid valve. One terminal of the solenoid valve 100 is connected to one terminal Ubat of the supply voltage. The other terminal of the solenoid valve 100 is connected via a switching means (switch) 110 to the ground connection of the supply voltage.

The switching means 110 is driven by a control unit 120. The control unit 120 is further connected to the supply voltage and to at least one sensor 130 for detecting an operating characteristic variable.

The control unit includes a quantity predetermining device 122 which is connected at least to the sensor 130. The quantity predetermining device 122 applies a first signal to a junction point 124. The output signal Tst of a correction device 128 is applied to the second input of the junction point 124. The junction point 124 applies the corrected injection time to an output stage 126. The output stage 126 then drives the switching means appropriately.

FIG. 1 is exemplary only of the device according to the present invention. Thus, for example, a measurement resistor can also be provided which detects the current flowing through the solenoid valve. Furthermore, the sequence of the switching means 110 and of the solenoid valve 100 can be interchanged. The output stage 126, the quantity predetermining device 122, and the correction device 128 can be implemented as one physical unit. The quantity predetermining device 122 is normally an engine controller which controls the power output of the internal combustion engine.

The switching means is preferably implemented as a transistor, especially as a field-effect transistor.

High-resistance injection valves are preferably used for cost reasons. In such valves, the majority of the electrical power is converted in the valve coil. This leads to a considerable increase in the temperature of the valve.

In the case of coils whose resistance changes as a function of the temperature, this leads to a change in the pull-in time and/or the drop-out time as a function of the coil temperature. Since the temperature depends on the applied duty ratio of the valve control, the duty ratio also influences the delay times. As a result of the variation of the injection quantity, this can lead to unacceptable noxious emissions from the internal combustion engine.

According to the present invention, the control unit 120 compensates for the influence of the coil temperature on the injected fuel quantity.

The device according to the present invention operates as follows. On the basis of the operating conditions detected by means of the sensors, the quantity predetermining device 122 calculates a basic injection duration T. The junction point 124 adds the output signal Tst of the correction device 128 to this basic injection duration T. The output signal of the correction device 128 is the delay time Tst. The output stage 126 applies a drive signal to the switching means 110 for the time duration of the overall injection duration TG calculated in this way.

The output stage 126 applies a pulsed signal to the switching means, which signal is at a specific duty ratio. This duty ratio can be predetermined as a function of various operating states.

Figure 2:
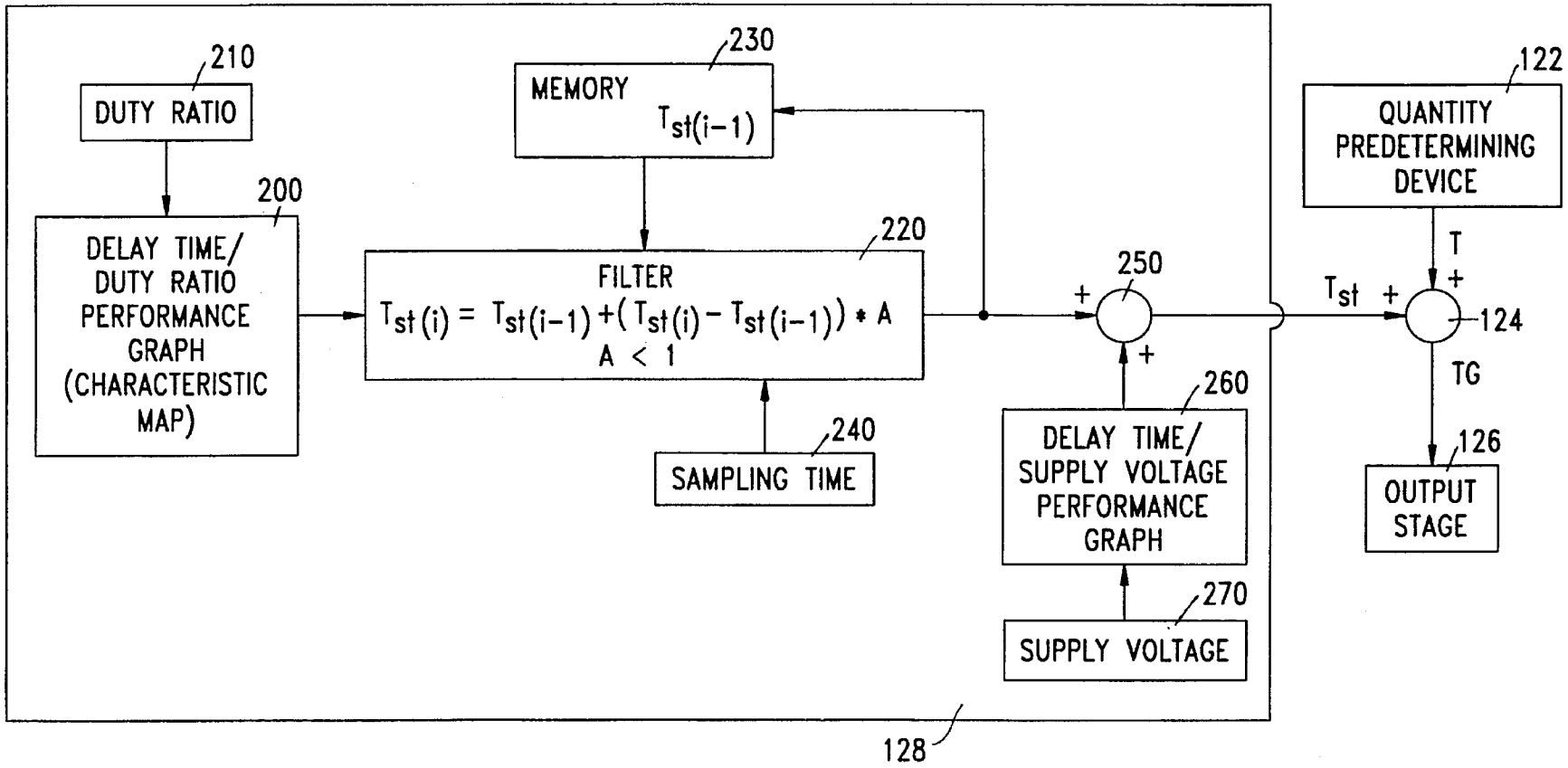
FIG. 2 shows a more detailed block diagram of an embodiment of the correction device of FIG. 1.

According to the present invention, the correction device 128 corrects the influence of the coil temperature on the injected fuel quantity. An embodiment of the correction device 128 according to the present invention is illustrated in more detail in FIG. 2.

The correction device 128 is constructed as follows. A signal from a duty ratio predetermining device 210 is applied to a first performance graph (characteristic map) 200. The output signal of the first performance graph 200 passes to a filter 220. A memory 230 and a sampling time predetermining device 240 also apply signals to the filter. The output of the filter is connected to the input of the memory 230 and to a junction point 250. In one particularly advantageous embodiment, the output signal of a second performance graph 260, to which the output variables of a voltage predetermining device 270 (operating voltage) is supplied as the input variable, passes to the second input of the junction point 250. The output variable of the junction point 250 is used as the output variable of the correction device 128.

This correction device 128 according to the present invention operates as follows. The delay time of the valve is stored in the first performance graph 200 as a function of the duty ratio at which the valve 100 is driven by the output stage 126. The relationship between the delay time and the duty ratio is determined experimentally.

The delay time determined in this way is now supplied to the filter 220, which takes into account the time-dependent change in the coil temperature. This is preferably in the form of an exponential function with respect to time. It is provided for this purpose that, in a fixed time frame which is governed by the sampling time predetermining device 240, the difference between the instantaneously read delay time and the delay time calculated in the preceding time frame is multiplied by a constant factor A. A positive number less than 1 is preferably selected as the factor A. The filtering is preferably carried out in accordance with the relationship:

$$T_{s(i)}=T_{s(i-1)}+(T_{sso11}-T_{s(i-1)})*A$$

In this case, the value $T_{s(i)}$ is the instantaneous delay time; the value $T_{s(i-1)}$ is the delay time for the preceding calculation; the value $T_{sso11}$ is the required value of the delay time; and A is a constant.

The result thus obtained is added to the delay time calculated from the preceding cycle. This result is the new delay time, which is used for injection time correction and is buffer-stored in the memory 230 for the next calculation cycle.

The device can be matched to the respective solenoid valves by suitable selection of the time frame and the parameter A.

A preferably additive correction is subsequently carried out at the junction point 250, as a function of the supply voltage. A correction value which is a function of the supply voltage Ubat is for this purpose stored in a second performance graph 260. This subsequent correction is necessary especially when relatively large dynamic voltage changes occur in the supply voltage, such as those which occur in motor vehicles, for example. In this case, the delay time changes, which are the result of fluctuations of the supply voltage, may not be damped out by the filter 220.

In a refinement of the present invention, it can also be provided for the second performance graph 260 to be integrated into the first performance graph 200. This means that the first performance graph would be of multidimensional design. The delay time is stored as a function of the duty ratio and of the battery voltage.

The method of operation according to the present invention results in the advantage that high-resistance solenoid valves can be used without adversely affecting exhaust gas emissions, even if their resistances are clearly temperature-dependent.

What is claimed is:

1. A method of driving an electromagnetic load, comprising the steps of:

predetermining a basic time duration during which the load is to be driven;

determining a correction delay time as a function of a power supplied to the load;

generating a corrected time duration by correcting the basic time duration of driving the load as a function of the correction delay time; and driving the load for the corrected time duration.

2. The method according to claim 1, wherein the load includes a solenoid valve.

3. The method according to claim 2, wherein the valve influences a fuel quantity to be injected into an internal combustion engine.

4. The method according to claim 1, wherein the power supplied to the load is determined as a function of a duty ratio of the driving of the load.

5. The method according to claim 1, wherein the correction delay time is determined as a further function of a value of a supply voltage coupled to the load.

6. The methods according to claim 1, further comprising the step of filtering the correction delay time.

7. The methods according to claim 6, wherein the correction delay time is filtered in accordance with the equation:

$$T_{s(i)}=T_{s(i-1)}+(T_{ssoll}-T_{s(i-1)})*A$$

wherein $T_{s(i)}$ is an instantaneous delay time;

$T_{s(i-1)}$ is a preceding delay time;

$T_{ssoll}$ is a required delay time; and

A is a constant.

8. A device for controlling an electromagnetic load, comprising:

a quantity predetermining device for predetermining a basic time duration during which the load is to be driven;

a correction device for determining a correction delay time as a function of a power supplied to the load;

a combining device for generating a corrected time duration by combining the basic time duration of driving the load and the correction delay time; and an output stage for driving the load in accordance with the corrected time duration.

9. The device according to claim 8, wherein the load includes a solenoid valve.

10. The device according to claim 9, wherein the valve influences a fuel quantity to be injected into an internal combustion engine.

11. The device according to claim 8, wherein the correction device includes a storage device for storing the correction delay time as a function of a duty ratio of the driving of the load.

* * * * *